United States Patent [19]

Baldenko et al.

[11] Patent Number: 4,567,953

[45] Date of Patent: Feb. 4, 1986

[54] BOTTOM-HOLE MULTISTART SCREW MOTOR

[76] Inventors: Dmitry F. Baldenko, Sevastopolsky prospekt, 83, korpus 1, kv. 88, Moscow; Talgat N. Bikchurin, ulitsa Radischeva, 20, kv. 8, Almetievsk TASSR; Jury V. Vadetsky, shosse Kosmonavtov, 131, kv. 31, Perm; Moisei T. Gusman, Vorobievskoe shosse, 11, kv. 69, Moscow; Anatoly M. Kochnev, prospekt Dekabristov, 18, kv. 77; Samuil S. Nikomarov, ulitsa Stakhanova, 42, kv. 10, both of Perm, all of U.S.S.R.

[21] Appl. No.: 227,056

[22] Filed: Dec. 10, 1980

[51] Int. Cl.[4] ..... E21B 4/02

[52] U.S. Cl. ..... 175/107; 418/48

[58] Field of Search ..... 175/107; 418/48

[56] References Cited

U.S. PATENT DOCUMENTS

| | | | |
|---|---|---|---|
| 3,112,801 | 12/1963 | Clark et al. | 175/107 |
| 3,982,858 | 9/1976 | Tschirky | 418/48 |
| 4,187,061 | 2/1980 | Jürgens | 175/107 |
| 4,397,619 | 8/1983 | Alliquander et al. | 418/48 |

*Primary Examiner*—Stephen J. Novosad
*Assistant Examiner*—William P. Neuder
*Attorney, Agent, or Firm*—Burgess, Ryan & Wayne

[57] ABSTRACT

A multistart helical planetary gear motor, comprising a stator 3 having an internal helical thread and a rotor 4 having an external helical thread and arranged eccentrically within the stator 3. The rotor 4 and stator 3 form a kinematic couple which is in permanent engagement similarly to an internal gearing, with the number of the stator teeth being greater than the number of rotor teeth by unity. The ratio of pitches of the helical threads of the stator 3 and the rotor 4 is directly proportional to the ratio of their respective numbers of teeth. The ratio of pitches of the helical surfaces of the stator 3 and the rotor 4 to their respective pitch diameters ranges substantially from 5.5 to 12.

2 Claims, 4 Drawing Figures

BOTTOM-HOLE MULTISTART SCREW MOTOR

FIELD OF THE ART

The invention relates to well drilling devices, and more particularly, to bottom-hole multistart screw motors.

The invention may be most advantageously used in bottom-hole hydraulic screw motors for drilling oil, gas and prospecting boreholes.

BACKGROUND ART

Known in the art are bottom-hole screw motors for drilling wells, working members of which form a multistart helical planetary gear mechanism. The mechanism includes a stator and a rotor. The stator comprises a casing internally provided with a resilient lining having the working surface in the form of a helical thread. The stator accommodates a rotor which is arranged eccentrically with respect to the stator and is externally provided with a helical thread.

The rotor and stator form a kinematic couple which is in permanent engagement similarly to an internal gearing, and they define closed cavities.

The axis of the rotor is displaced with respect to the axis of the stator by the amount of an eccentricity "e". the number of teeth of the helical surfaces of the stator and rotor correspond to the number of starts of their helical threads.

In the helical planetary gear mechanism the number of stator teeth is greater than the number of rotor teeth by unity. The ratio of stator and rotor pitches is directly proportional to the ratio of their teeth numbers.

Cycloidal gearing constitutes the basis for the formation of the cross-sectional configuration of a multistart helical planetary gear mechanism.

The cross-sectional shape of the stator is formed by alternating portions of cycloidal curves and arcs of circle. The cross-sectional shape of the rotor is formed by an envelope of the stator profile obtained by rolling maximum pitch circle of the rotor, chosen so as to ensure continuous engagement of the helical surfaces of the rotor and stator, inside an initial pre-set circle of the stator.

Geometrical parameters of working members of multistart screw motors are partially covered by U.S. Pat. No. 3,822,972 of Nov. 20, 1972, IPC F Olc 1/10, which teaches optimum dimensional proportioning of working members in the cross-section.

In screw motors, the three-dimensional configuration of helical surfaces of the rotor and stator depends on a parameter which represents the ratio of pitches of the helical surfaces of the stator and rotor to their respective pitch diameters. In prior art bottom-hole screw motors this parameter ranges from 4 to 4.6. Motors featuring a value of the parameter within this range are characterized by unstable starting performance resulting from the possibility of self-braking of working members of a motor.

DISCLOSURE OF THE INVENTION

The invention resides in the provision of a bottom-hole screw motor having such an optimum helix angle which eliminates self-braking of motor under all operating conditions with a modest increase in leakage rate through the working members.

The invention materially consists in that in a multistart helical planetary gear motor, comprising a stator internally provided with a helical thread and a rotor which is arranged eccentrically in the stator and is externally provided with a helical thread, the rotor and stator forming a kinematic couple which is in permanent engagement similarly to an internal gearing, the number of stator teeth being greater than the number of rotor teeth by unity, and the ratio of pitches of helical threads of the stator and rotor being directly proportional to the respective ratio of the numbers of their teeth, according to the invention, the ratio of pitches of the helical surfaces of the stator and rotor to their respective pitch diameters ranges substantially from 5.5 to 12.

The provision of a multistart screw motor having the above-specified geometrical parameters of working members makes it possible to eliminate self-braking phenomena under all operating conditions of the motor, especially during starting, whereby reliability and operating stability of the motor are improved.

BRIEF DESCRIPTION OF THE DRAWINGS

The invention will now be described in detail with reference to the accompanying drawings, in which.

BEST MODE OF CARRYING OUT THE INVENTION

Figure 1:
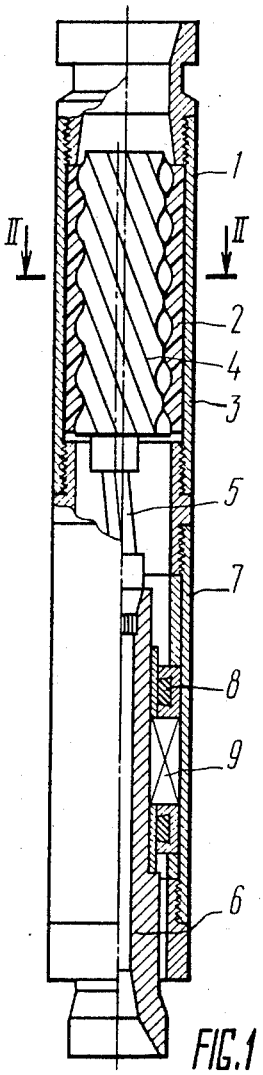
FIG. 1 shows a general view, in longitudinal section, of a bottom-hole multistart screw motor according to the invention.

FIG. 1 shows an embodiment of a hydraulic screw motor for drilling wells. In this embodiment the motor is actuated by a fluid supplied under pressure; water, drilling mud and other liquids may be used as the fluid.

The type of fluid under pressure is chosen depending on specific geological and production drilling conditions.

A screw motor comprises a casing 1 in which is rigidly secured a resilient lining 2. The lining 2 is normally made of rubber, but it may also be made of any other resilient material. The lining is internally provided with a multistart helical thread. The number of starts of the helical thread corresponds to the number of teeth $Z_1$ of the helical surface of the stator. In this specific embodiment $Z_1=10$, although it may largely vary depending on technical requirements imposed on the motor.

The casing 1 with the lining 2 form a stator 3 of the screw motor according to the invention.

The stator 3 accommodates a rotor 4 which is normally made of metal. The rotor is externally provided with a helical thread with a number of teeth $Z_2=9$. The rotor 4 is installed in the stator 3 with an eccentricity "e" (FIG. 2), and the ratio of a pitch T (FIG. 3) of the helical surface of the stator to a pitch t of the helical surface of the rotor is directly proportional to the ratio of their numbers of teeth, that is $$T/t=Z_1Z_2$$

The stator 3 and the rotor 4 (FIG. 2) form a kinematic couple which is in permanent engagement similarly to an internal gearing with a difference in the numbers of teeth equal to unity. The helical teeth of the rotor 4 and stator 3 engage one another to define chambers closed over the length of pitch T.

Figure 3:
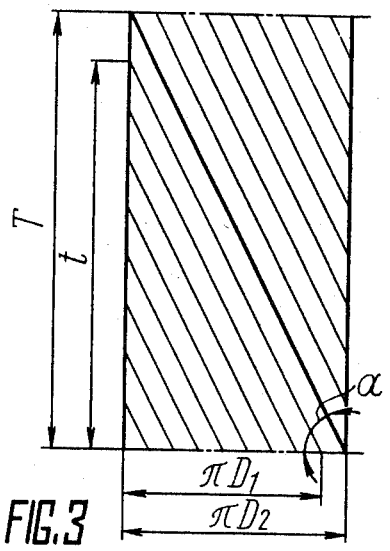
FIG. 3 shows a developed view of working members of the motor.

FIG. 3 shows a developed view of the lateral surfaces of the stator and rotor over the length of the stator pitch T having pitch diameters $D_1$ and $D_2$, respectively. Solid lines show lines of contact of the stator and rotor, and intervals between these lines represent chambers filled with a fluid.

Figure 2:
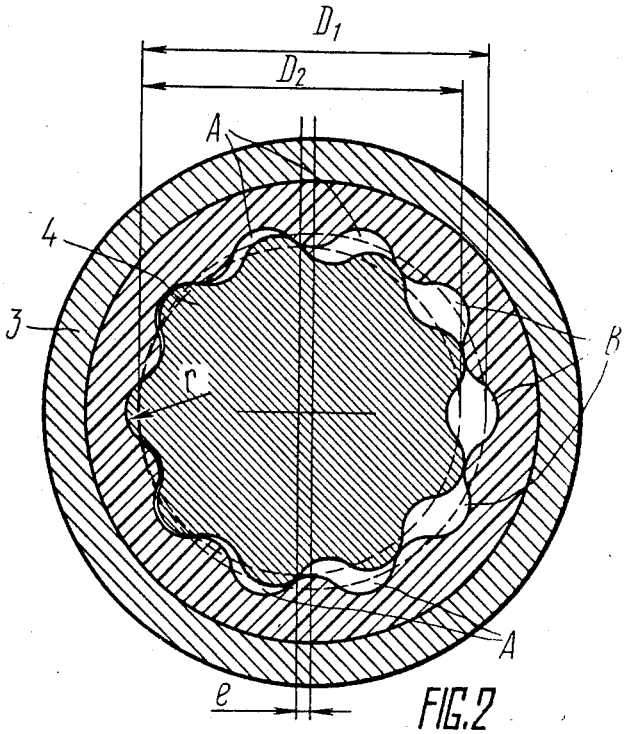
FIG. 2 is a sectional view taken along the line II—II in FIG. 1.

FIG. 2 shows the cross-sectional configuration of a helical planetary gear mechanism in which the cross-sectional shape of the stator 3 is formed by alternating portions of a cycloidal curve defining the teeth of the stator 3 and arcs of circles of a radius "r" defining teeth spaces in the cross-section of the stator.

The cycloidal curve which constitutes the basis for the construction of the profile of the stator 3 is formed by rolling without sliding over an initial pre-set circle of the stator 3 another conditional circle of a diameter which is chosen depending on the eccentricity "e". The initial pre-set circle of the stator generally depends on expected operation conditions of the mechanism and is determined by maximum diametrical size which is admissible under given conditions.

The cross-sectional profile of the rotor 4 is conjugated to the profile of the stator 3 and is formed by an envelope of the initial profile of the stator 3 by rolling the pitch circle of the rotor 4 over the pitch circle of the stator 3.

The rotor 4 is connected by means of a double-hinged joint to an output shaft 6 having at the end thereof a drilling tool of the bottom-hole motor attached thereto (not shown). The output shaft 6 is journalled in a housing 7 by means of radial bearings 8. Thrust bearings provided in the housing 7 are used for taking-up axial loads during operation of the bottom-hole motor.

The bottom-hole motor functions in the following manner.

A hydraulic pump feeds liquid under pressure along pipes to a cavity A of the motor in which the same pressure is established. The cavity A is referred to as a high-pressure cavity. The helical teeth of the rotor 4 and stator 3 engage one another to define chambers closed over the length of the pitch T of the helical surface of the stator 3. A number of chambers thus communicate with the high-pressure cavity A, and a number of chambers communicate with a low-pressure cavity B. Therefore, an unbalanced force occurs in every cross-section of the mechanism, hence a torque is developed. Under the action of these forces radial deformation of the resilient lining 2 of the stator 3 takes place, and the rotor 4 is caused to displace transversely of its axis, whereafter the rotor performs a planetary motion to roll over the teeth of the stator 3 (in the clockwise direction in FIG. 2).

The rotor 4 imparts rotary motion to the output shaft 6 through the double-hinged joint 5, and the motion is transmitted to a drilling tool of the bottom-hole motor.

As shown by the theoretical studies and experiments, starting performance and reliability of a screw motor in operation largely depend on a parameter $C_t$.

The parameter $C_t$ represents a ratio of stator and rotor pitches T and t to their respective pitch diameters $D_1$ and $D_2$.

Assuming that the working members of the motor form a screw-and-nut gearing, the relationship between thereoretical torque M of the motor and axial force G applied to the rotor is as follows:

$$M = GD\ tg(\alpha - \beta)/2,$$

where

D is the pitch diameter of a screw-and-nut gearing, $\alpha$ is the helix angle, $\beta$ is the angle of friction equal to are tg f, f is coefficient of friction of a system rotor-stator.

Under certain conditions, in a bottom-hole screw motor, the coefficient of static friction f may rake values close to or even greater than unity, and the angle of friction $\beta$ in such cases approximates the angle $\alpha$.

Therefore, such friction conditions are possible when the value of $(\alpha-\beta)\rightarrow 0$, and self-braking occurs in the mechanism so that the motor cannot be started.

This disadvantage is eliminated in the bottom-hole screw motor according to the invention the working members of which form a multistart helical planetary gear mechanism featuring the ratio of the pitch t of helical surface to the pitch diameter D substantially within the range of $C_t=5.5$ to 12.

For working members featuring the parameter $C_t=5.5$ to 12 the helix angle is within the range of $\alpha=62-75°$ so that self-braking of the mechanism is prevented. This relationship of geometrical parameters of working members is illustrated in FIG. 3.

Figure 4:
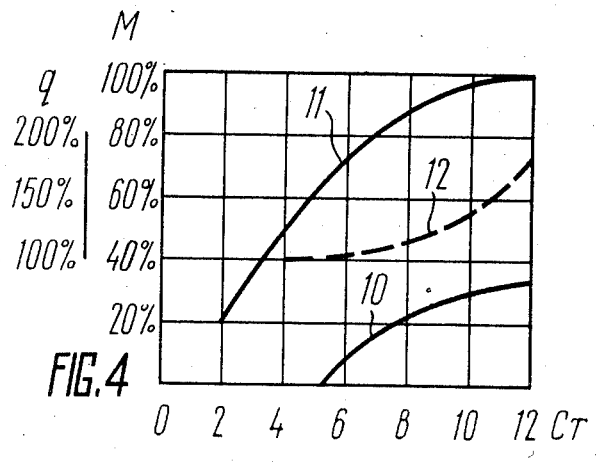
FIG. 4 is a chart showing the variations of the torque developed by the motor and liquid leakage rate in working members depending on a parameter $C_t$.

Physical sense of a self-braking phenomenon occuring in screw motors is illustrated in FIG. 4 showing the variation of torque developed by the motor depending on the parameter $C_t$, and also the change in relative leakage rate.

Two values—torque M developed by the motor as a percentage ratio to the torque developed at $C_t=12$ and relative leakage rate q with the reference leakage rate (100%) at $C_t=4.6$—are plotted at the ordinates in FIG. 4.

The abscissa is the dimensionless parameter $C_t$.

Curve 10 shows the relationship of torque developed by the screw motor verssus $O_t$ at maximum coefficient of friction, and curve 11 shows the relationship of torque developed by the motor versus $C_t$ at minimum coefficient of friction. Curve 12 shows the relationship of leakage rate in working members of motors versus the parameter $C_t$.

As it can be seen from FIG. 4, in motors characterized by $C_t<5.5$ at maximum coefficient of friction $f_{max}$ (curve 10) friction losses may be so big that the developed torque approaches zero, and self-braking conditions occur. At minimum coefficient of friction (curve 11) the self-braking conditions occur in mechanisms with $C_t\approx 2$. Therefore, to ensure reliable operation of a motor, it is sufficient that the parameter $C_t$ should be substantially at least 5.5. This is the lower limit of the parameter $C_t$. The upper limit of the parameter $C_t$ depends on the leakage rate through the working members. As can be seen from FIG. 4 (curve 12), the leakage rate starts intensely growing at $C_t>12$.

The range of the parameter $C_t$ according to the invention ensures stable starting and high reliability of the motor in operation.

Another advantage of the motor according to the invention resides in that an increase in the parameter $C_t$, with the other geometrical parameters of the working members remaining unchanged, results in a reduction of rotary speed of the output shaft so that the footage per bit run increases.

INDUSTRIAL APPLICABILITY

The invention enables a substantial improvement of reliability and starting performance of the motor, and output performance of the motor is also improved to a certain extent.

Savings from the introduction of the motor according to the invention result from saving of trip time associated with failure of a motor deep in the well and also from increased tool footage.

We claim:

1. A multistart helical planetary gear motor, comprising a stator internally provided with a helical thread; a rotor externally provided with a helical thread and arranged eccentrically within said stator, said rotor and stator forming a kinematic couple which is in permanent engagement similarly to an internal gearing, with the number of teeth of said stator being greater than the number of teeth of said rotor by unity, the ratio of pitches of the helical threads of said stator and rotor being directly proportional to a respective ratio of their numbers of teeth, characterized in that the ratio of pitches of helical surfaces of said stator and rotor to their respective pitch diameters lies substantially within a range of from 5.5 to 12.

2. A multistart helical planetary gear motor according to claim 1; wherein said rotor is externally provided with a multistart helical thread.

* * * * *